US007532087B2

(12) United States Patent
Mizutani

(10) Patent No.: US 7,532,087 B2
(45) Date of Patent: May 12, 2009

(54) SWITCH CIRCUIT

(75) Inventor: Hiroshi Mizutani, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 274 days.

(21) Appl. No.: 11/492,792

(22) Filed: Jul. 26, 2006

(65) Prior Publication Data

US 2007/0024389 A1 Feb. 1, 2007

(30) Foreign Application Priority Data

Jul. 29, 2005 (JP) ..... 2005-221147

(51) Int. Cl.
*H01P 1/15* (2006.01)

(52) U.S. Cl. ..... 333/104; 333/262

(58) Field of Classification Search ..... 333/103, 333/104, 262, 101

See application file for complete search history.

(56) References Cited

U.S. PATENT DOCUMENTS

| | | | | |
|---|---|---|---|---|
| 5,485,130 | A * | 1/1996 | Nakahara et al. | 333/104 |
| 6,998,934 | B2 * | 2/2006 | Nakano | 333/103 |
| 7,106,146 | B2 * | 9/2006 | Tsukahara et al. | 333/104 |
| 7,280,006 | B2 * | 10/2007 | Hase | 333/103 |

FOREIGN PATENT DOCUMENTS

| | | | |
|---|---|---|---|
| JP | 09-162602 | A | 6/1997 |
| JP | 2910681 | B2 | 4/1999 |
| JP | 3099880 | B2 | 8/2000 |
| JP | 2002-033602 | A | 1/2002 |

OTHER PUBLICATIONS

H. Mizutani et al., Compact DC-60-GHZ HJFET MMIC Switched Using OHMIC Electrode-Sharing Technology, IEEE Trans. MTT, vol. 46, No. 11, pp. 1597-1603, Nov. 1998.

H. Mizutani et al., DC-110-GHZ MMIC Traveling-Wave Switch, IEEE Trans. MTT, vol. 48, No. 5, pp. 840-845, May 2000.

K-Y. Lin et al., Millimeter-Wave MMIC Passive HEMT Switches Using Traveling-Wave Concept, IEEE Trans. MTT, vol. 52, No. 8, pp. 1798-1808, Aug. 2004.

J. Kim et al., A High-Performance 40-85 GHz MMIC SPDT Switch Using FET-Integrated Transmission Line Structure, IEEE Microwave and Wireless Components letters, vol. 13, No. 12, Dec. 2003.

* cited by examiner

*Primary Examiner*—Benny Lee
*Assistant Examiner*—Alan Wong
(74) *Attorney, Agent, or Firm*—Sughrue Mion, PLLC

(57) ABSTRACT

The switch circuit 1 includes a common terminal 10 (common port), a plurality of branch terminals 22, 24, a common path P0 connecting the common terminal 10 and a diverging point N, branch paths P1, P2 connecting the diverging point N and the branch terminals 22, 24 respectively, distributed constant FETs 32, 34 respectively provided in the branch paths P1, P2, and transmission lines 42, 44 provided between the diverging point N on the branch paths P1, P2 and the distributed constant FETs 32, 34 respectively. Here, the transmission lines 42, 44 are longer than 45% of Λ/4 but shorter than Λ/4, when Λ designates a propagation wavelength under an operating frequency.

5 Claims, 19 Drawing Sheets

SWITCH CIRCUIT

This application is based on Japanese patent application No. 2005-221147, the content of which is incorporated hereinto by reference.

BACKGROUND

1. Technical Field

The present invention relates to a switch circuit.

2. Related Art

Active elements employed in a switch circuit that operates under a microwave band or a millimeter-wave band (millimeter-wave band covers a range of 30 GHz to 300 GHz) include a PIN diode and a field effect transistor (hereinafter, FET), each of which has its characteristics. In particular, to reduce insertion loss and improve isolation performance it is essential to reduce ON resistance and OFF capacitance of the active element, for which the PIN diode is more superior. In many of the millimeter-wave switch circuits of 30 GHz or higher especially, the PIN diode is employed for reducing the resistance and the capacitance. The PIN diode is, however, inferior to the FET in the following aspects. The PIN diode has poor compatibility with a heterojunction transistor process to constitute most of millimeter-wave monolithic integrated circuit (MMIC), and consumes a larger power under a low resistance.

The FET can be handled as a two-terminal device when simplified, so as to be utilized as an ON resistance $R_{on}$ between the source and the drain when the channel is open, and employed as an OFF capacitance $C_{off}$ between the source and the drain when pinched off, in the circuit.

From the viewpoint of circuit configuration, various types have been developed and commercialized, such as a resonance type, a non-resonance type and distributed constant type (traveling wave type). The resonance type is less advantageous in achieving a broadband characteristic, because of depending on resonance. The non-resonance type is, for example, built with a series-shunt configuration of the active element (FIG. 9A). This is quite advantageous for a broadband operation because of not utilizing the resonance, however unable to operate under high frequency (no more than 60 GHz or so) when employed in a Single Pole n-Throw (hereinafter, SPnT) switch, for the following reason.

As described in the non-patent document 1 (H. Mizutani et al., IEEE Trans. MTT, Vol. 46, No. 11, pp. 1597-1603, November 1998), the OFF branch of a SPST switch can be equivalent to a series capacitance-shunt resistance configuration (FIG. 9B). An increase in frequency leads to reduced impedance of the series capacitance, and hence isolation characteristic is degraded (FIG. 10). In contrast, the ON branch can be equivalent to a series resistance-shunt capacitance configuration (FIG. 9C), and accordingly the insertion loss increases with the increase in frequency (FIG. 10). Consequently, the ON/OFF ratio, which is an important factor of the switch, is degraded. As a result, if the ON/OFF ratio of 20 dB or more is required in the foregoing configuration, the upper limit of the frequency is around 60 GHz (FIG. 10).

Meanwhile, the patent documents 1 and 2 (Japanese Laid-open patent publications No. 2910681 and No. 3099880) disclose a traveling wave type SPST switch that includes a distributed constant FET, which achieves low power consumption and high compatibility between the heterojunction FET process. The non-patent document 2 (H. Mizutani et al., IEEE Trans. MTT, Vol. 48, No. 5, pp. 840-845, May 2000) also describes the operation of such switch in details. The distributed constant FET refers to, as shown in FIG. 11, a one gate finger structure FET including a pair of ohmic electrodes (source electrode and drain electrode) disposed across the gate electrode, in which the gate finger length l including the ohmic electrode is 1/16 or longer of the propagation wavelength.

Referring to FIG. 12, an equivalent circuit of the distributed constant FET can be expressed as a circuit including an infinite number of FETs of a minute length connected to one another via the gate, and a transmission line constituted of the drain electrode of each FET, thus constituting the distributed constant FET of a finite length. The circuit of FIG. 12 can also be expressed as FIG. 13, based on a lumped constant element. In an ON state the distributed constant FET is pinched off, and hence the shunt conductance G equals 0 S. Accordingly, the FET operates in the equivalent circuit associated with a lossless transmission line, thereby achieving a low insertion loss characteristic in the broadband (FIG. 14A). In an OFF state in contrast, the distributed constant FET is in an open channel state, so as to act as the equivalent circuit associated with the transmission line that incurs a loss primarily originating from the shunt conductance G, as shown in FIG. 13. Because of an increase in impedance caused by the series inductance $L_{TL}$, the broadband characteristic that the isolation monotonously increases with the frequency is achieved (FIG. 14B).

Thus, the traveling wave type switch including the distributed constant FET is quite useful in achieving the broadband characteristic. A report on the SPnT switch including the distributed constant FET, however, can only be found in a circuit including a coplanar waveguide reviewed hereunder, and no report is available yet regarding a circuit including a microstrip line. Accordingly, development of a traveling wave type SPnT switch including the distributed constant FET with a microstrip line has been eagerly sought for.

FIG. 15 is a circuit diagram of the SPDT switch according to the patent document 3 (Japanese Laid-open patent publication No. H09-162602). A diverging point a-end is connected to a grounded PIN diode 103 via a transmission line 101 of an electrical length of θ, and θ is 90° (=Λ/4, where Λ is a propagation wavelength), according to the disclosure. This circuit is described to operate as follows. When the PIN diode 103 is biased forward, the circuit can be considered as merely being equivalent to a resistance $R_s$, and when the PIN diode 103 is biased reversely, the circuit can be considered as merely being a capacitance $C_j$.

Generally, the ground point (short point) is converted to be open when its impedance is seen through the transmission line of Λ/4 in length. Accordingly, the resistance $R_s$ is quite small when the PIN diode 103 is biased forward, and hence in the SPDT switch shown in FIG. 15, the impedance is converted to be substantially open at the a-end when seen from the substantially short point through the transmission line of Λ/4 in length. Under such state a microwave signal is substantially totally reflected by the a-end toward the circuit on the side of the transmission line 101, and transmitted to the side of the transmission line 102 with low loss. In contrast, when the PIN diode 103 is biased reversely, the shunt capacitance $C_j$ acts as a part of a shunt capacitance constituting an equivalent circuit of the transmission line 101, so that a current runs through both of the transmission lines 101, 102. Accordingly, the microwave signal has its input power E split into ½ each at the a-end to be supplied to the transmission lines 101, 102 respectively, and then to a load connected to a b-end and c-end. In an ordinary SPDT switch, unlike the example of FIG. 15, the grounded diode is also connected to the c-end on the side of the transmission line 102 as on the side of the transmission line 101, so as to complementarily switch the bias of those transmission lines, thereby switching the propagation path of the microwave signal between the transmission line 101 and the transmission line 102. Such circuit is, despite being popularly utilized, difficult to achieve a high isolation characteristic in the broadband.

FIG. 16 is a circuit diagram of a SPDT switch according to the patent document 4 (Japanese Laid-open patent publication No. 2002-33602). The SPDT switch includes the distributed constant FET. Between ground lines between coplanar waveguides 118*a*, 118*b* and between coplanar waveguides 128*a*, 128*b*, inserted between a diverging point A and distributed constant FETs 111, 121, FETs 112, 113 and FETs 122, 123 are respectively inserted in series.

In the circuit thus configured, for example, pinching off the FETs 112, 113 on the OFF branch side disconnects the ground line on the OFF branch side, which allows blocking leakage of the signal power to the OFF branch, thereby improving the signal power transmission characteristic to the ON branch side, resulting in minimized insertion loss of the SPDT switch as a whole.

FIG. 17 is a circuit diagram of a traveling wave type SPDT switch according to the non-patent document 3 (K-Y. Lin et al., IEEE Trans. MTT, Vol. 52, No. 8, pp. 1798-1808, August 2004). This SPDT switch operates based on a similar principle to that of the traveling wave type switch including the distributed constant FET according to the patent documents 1, 2 and non-patent document 2. However, while the distributed constant FET that can be expressed as a complete distributed constant circuit is employed to constitute the traveling wave type switch in those cited documents, the SPDT switch according to the non-patent document 3 is different in that three basic cells including a combination of a separated FET and a transmission line are connected in series, thus simulatively constituting a traveling wave type switch.

As shown in FIG. 17, a diverging point is connected to the FET constituting the traveling wave type switch, via a transmission line having a length of Λ/4 of the propagation wavelength. Although the non-patent document 3 states that the transmission line from the diverging point to the FET is actually shorter than Λ/4 because the impedance $Z_{a1}$ of the traveling wave type SPST switch cell is not entirely substantial, the document includes no reference that enables determining a specific length of the transmission line. In addition, the non-patent document 4 (J. Kim et al., IEEE Microwave and Wireless Components letters, Vol. 13, No. 12, December 2003) also discloses a switch circuit based on a similar traveling wave type switch technique to that of the non-patent document 3. According to the non-patent document 4, a diverging point is connected to the distributed SPST switch, via a transmission line having a length of Λ/4 of 77 GHz.

As reviewed above, in the conventional SPDT switches the diverging point is connected to the FET or the diode, via the transmission line having a length of Λ/4 or shorter (though a specific length is not disclosed), or via the coplanar waveguide including the FETs inserted in series in the ground line.

SUMMARY OF THE INVENTION

Now, with respect to the SPnT switch, it is necessary to establish the conditions that allow maximizing the isolation of the OFF branch while maintaining the insertion loss under an ON state within a tolerance. Such conditions include the length of the transmission line between the diverging point and the FET. However, no reference is made regarding such length in any of the cited documents.

According to the present invention, there is provided a switch circuit comprising a common terminal; a plurality of branch terminals; a common path connecting the common terminal and a diverging point; a plurality of branch paths respectively connecting the diverging point and the branch terminals; a field effect transistor provided in each of the branch paths; and a transmission line provided in each of the branch paths, between the diverging point and the field effect transistor; wherein the transmission line is longer than 45% of Λ/4 but shorter than Λ/4, when Λ represents a propagation wavelength under an operating frequency.

In the switch circuit thus configured, the transmission line is longer than 45% of Λ/4 but shorter than Λ/4. The transmission line longer than 45% of Λ/4 allows suppressing the insertion loss in an ON state within a tolerance. Also, the transmission line shorter than Λ/4 enables maximizing the isolation of the branch path under an OFF state.

Thus, the present invention provides a switch circuit appropriate for maximizing the isolation of the OFF branch and suppressing the insertion loss in an ON state within a tolerance.

BRIEF DESCRIPTION OF THE DRAWINGS

The above and other objects, advantages and features of the present invention will be more apparent from the following description taken in conjunction with the accompanying drawings, in which.

DETAILED DESCRIPTION

Figure 1:
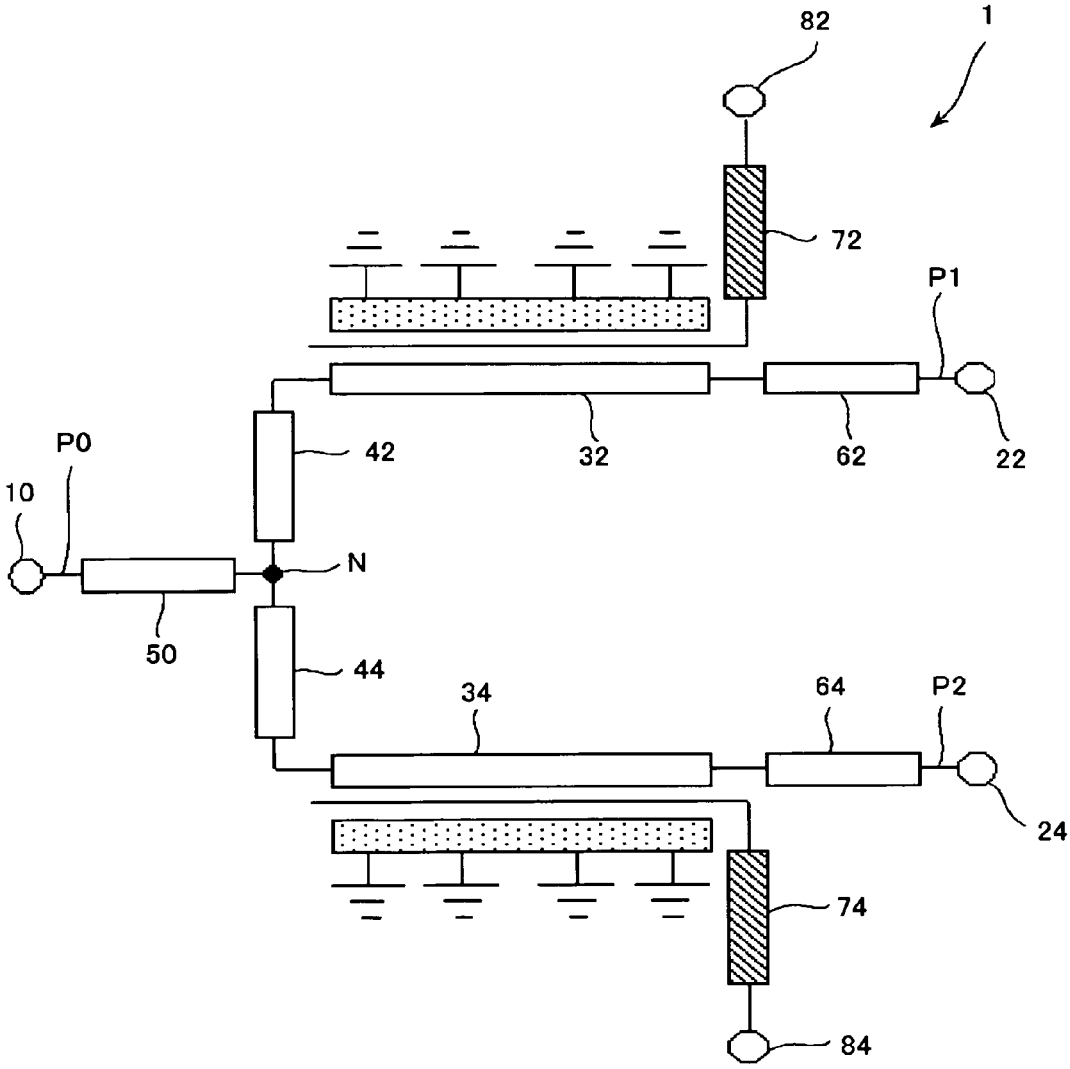
FIG. 1 is a circuit diagram of a switch circuit according to an embodiment of the present invention.

The invention will be now described herein with reference to illustrative embodiments. Those skilled in the art will recognize that many alternative embodiments can be accomplished using the teachings of the present invention and that the invention is not limited to the embodiments illustrated for explanatory purposes.

Hereunder, exemplary embodiments of a semiconductor device and a method of manufacturing the same according to the present invention will be described in details, referring to the accompanying drawings. In the drawings, same constituents are given the identical numerals, and duplicating description may not be repeated where appropriate.

FIG. 1 is a circuit diagram of a switch circuit according to an embodiment of the present invention. The switch circuit 1 is a traveling wave type SPDT switch including distributed constant FETs, applicable to, for example, a system for a microwave band and a millimeter-wave band. The switch circuit 1 includes a common terminal 10 (common port), a plurality of branch terminals 22, 24, a common path P0 connecting the common terminal 10 and a diverging point N, branch paths P1, P2 connecting the diverging point N and the branch terminals 22, 24 respectively, distributed constant FETs 32, 34 respectively provided in the branch paths P1, P2, and transmission lines 42, 44 provided between the diverging point N on the branch path P1, P2 and the distributed constant FET 32, 34 respectively. Here, the transmission lines 42, 44 are longer than 45% of $\Lambda/4$ but shorter than $\Lambda/4$, when $\Lambda$ designates a propagation wavelength under an operating frequency.

The switch circuit 1 is provided in a common path P0, and includes a transmission line 50 (matching circuit) that matches the impedance of the common terminal 10 and the impedance when a path in an ON state is seen from the common terminal 10 via either path that is OFF and connected in parallel to the diverging point N, out of the branch paths P1, P2.

To the common terminal 10, an end of the transmission line 50, which serves as the matching transmission line, is connected. The other end of the transmission line 50 is the diverging point N, to which the transmission lines 42, 44 serving as the branch transmission lines are connected in parallel. To the end of the transmission line 42 opposite to the diverging point N, the distributed constant FET 32 is connected. To the end of the transmission line 44 opposite to the diverging point N, the distributed constant FET 34 is connected. Between the distributed constant FET 32 and the branch terminal 22, a transmission line 62 is connected, and between the distributed constant FET 34 and the branch terminal 24 another transmission line 64 is connected.

Figure 11:
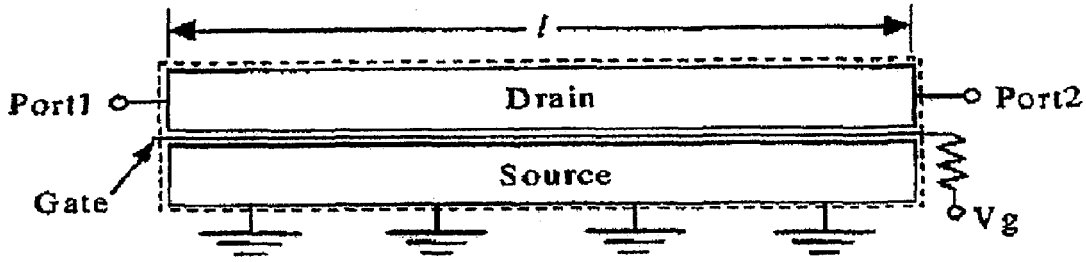
FIG. 11 RELATED ART
FIG. 11 is a schematic diagram showing a traveling wave type SPST switch including a conventional distributed constant FET.
Figure 12:
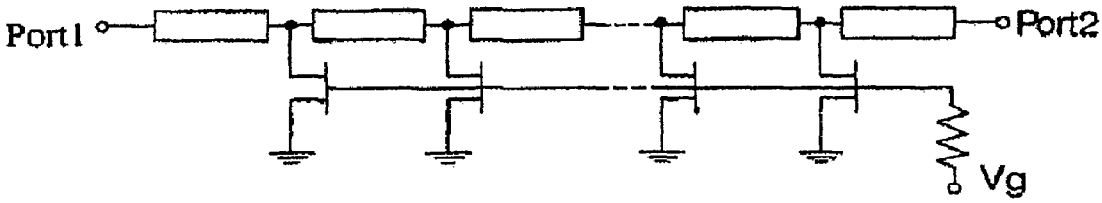
FIG. 12 RELATED ART
FIG. 12 is an equivalent circuit diagram of the traveling wave type SPST switch including the conventional distributed constant FET.
Figure 13:
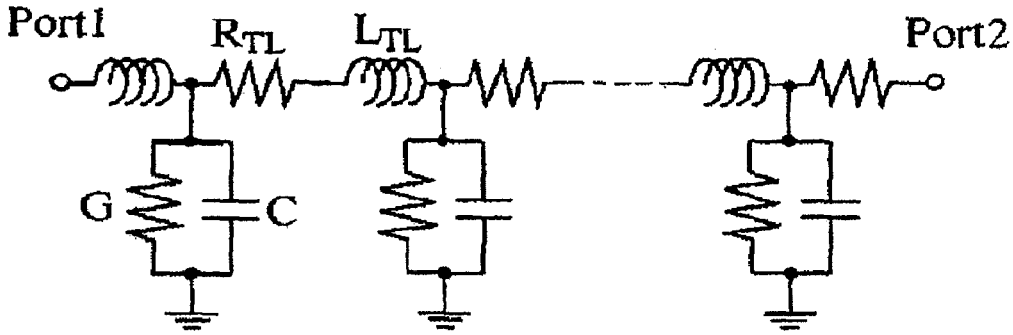
FIG. 13 RELATED ART
FIG. 13 is a circuit diagram expressed according to a lumped constant, equivalent to the traveling wave type SPST switch including the conventional distributed constant FET.
Figure 14A:
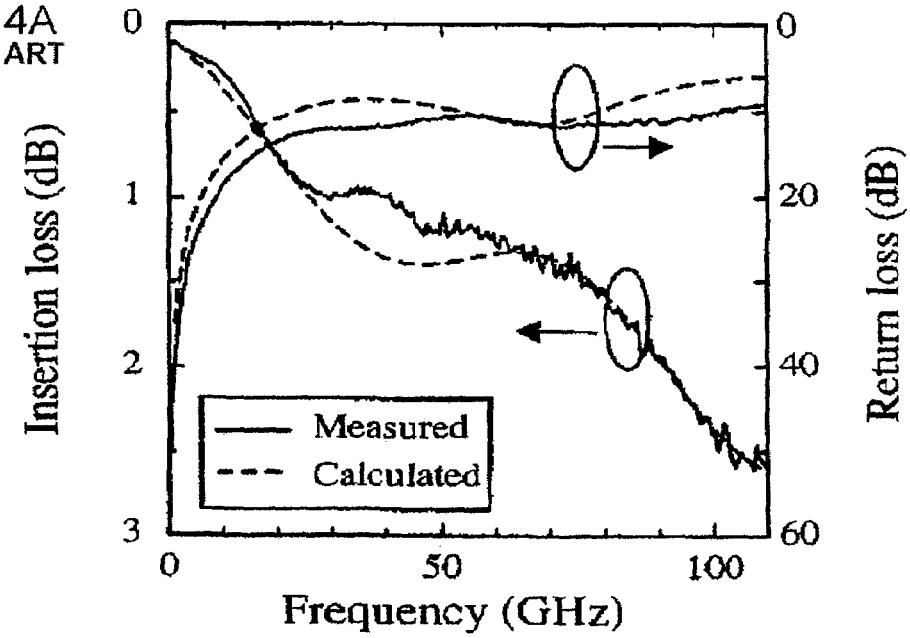
FIG. 14A RELATED ART
FIGS. 14A and 14B are graphs showing frequency characteristics of the conventional traveling wave type SPST switch including the conventional distributed constant FET, with respect to insertion loss and isolation respectively.
Figure 14B:
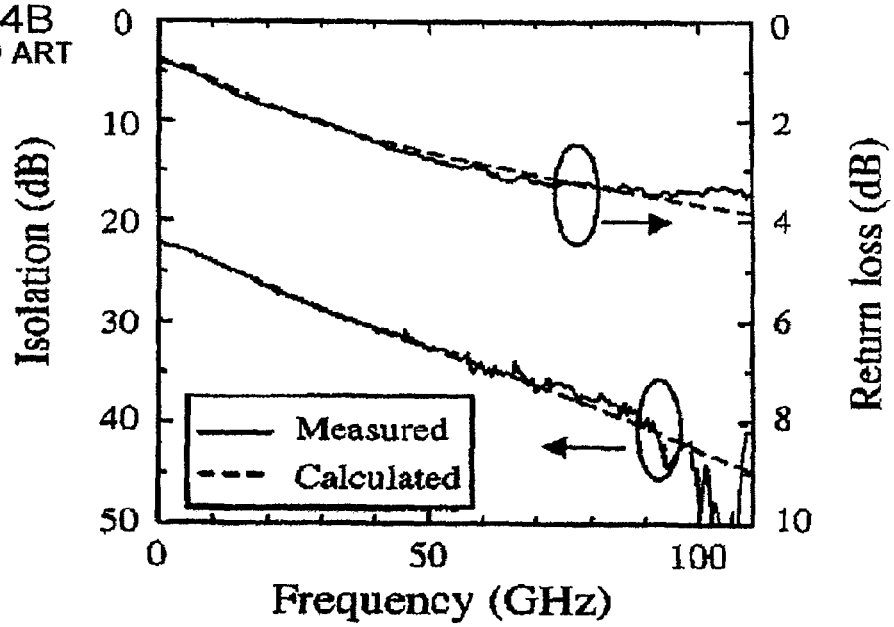
FIG. 14B RELATED ART
Figure 15:
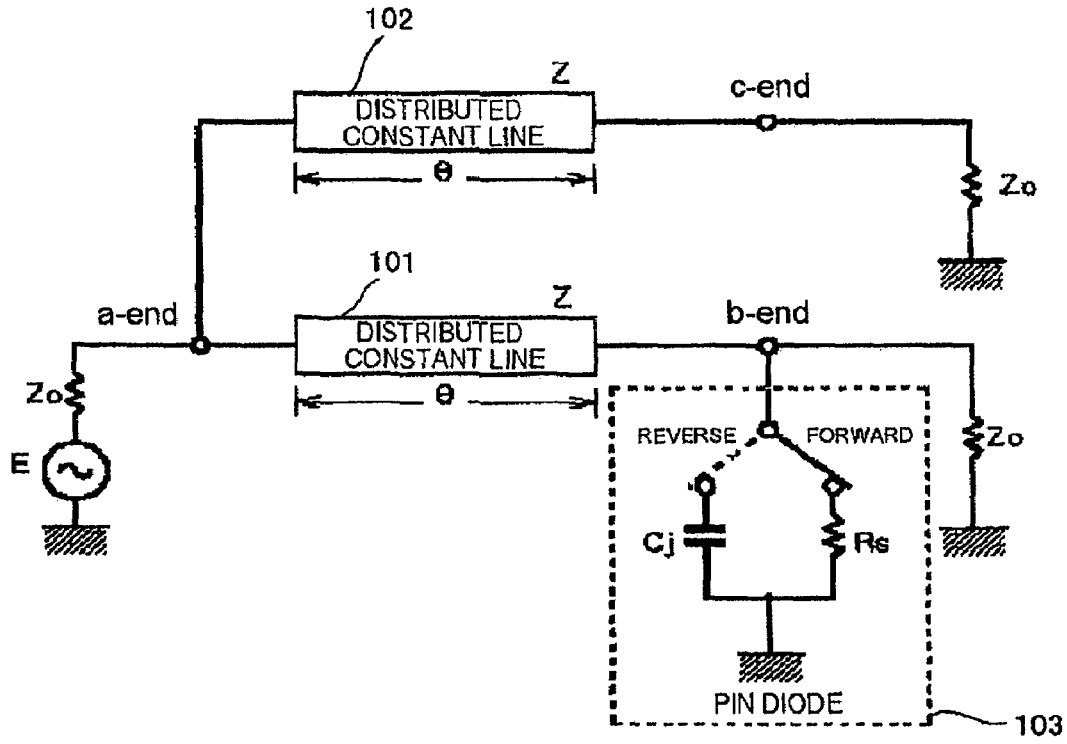
FIG. 15 RELATED ART
FIG. 15 is a circuit diagram of a SPDT switch according to the patent document 3.
Figure 16:
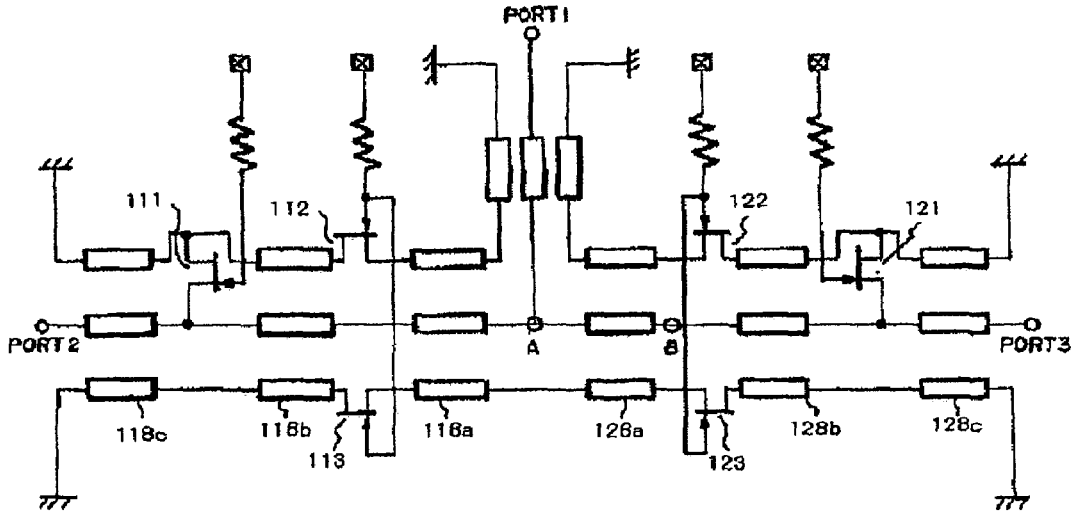
FIG. 16 RELATED ART
FIG. 16 is a circuit diagram of a SPDT switch according to the patent document 4.

To the gate of the distributed constant FET32, a control terminal 82 is connected via an isolation circuit 72 of a bias line. To the gate of the distributed constant FET34, a control terminal 84 is connected via an isolation circuit 74 of another bias line. The control terminals 82, 84 serve to apply a control voltage to the gate of the distributed constant FETs 32, 34 respectively. Here, the definition of the distributed constant FET is as already stated referring to FIG. 11.

Figure 18:
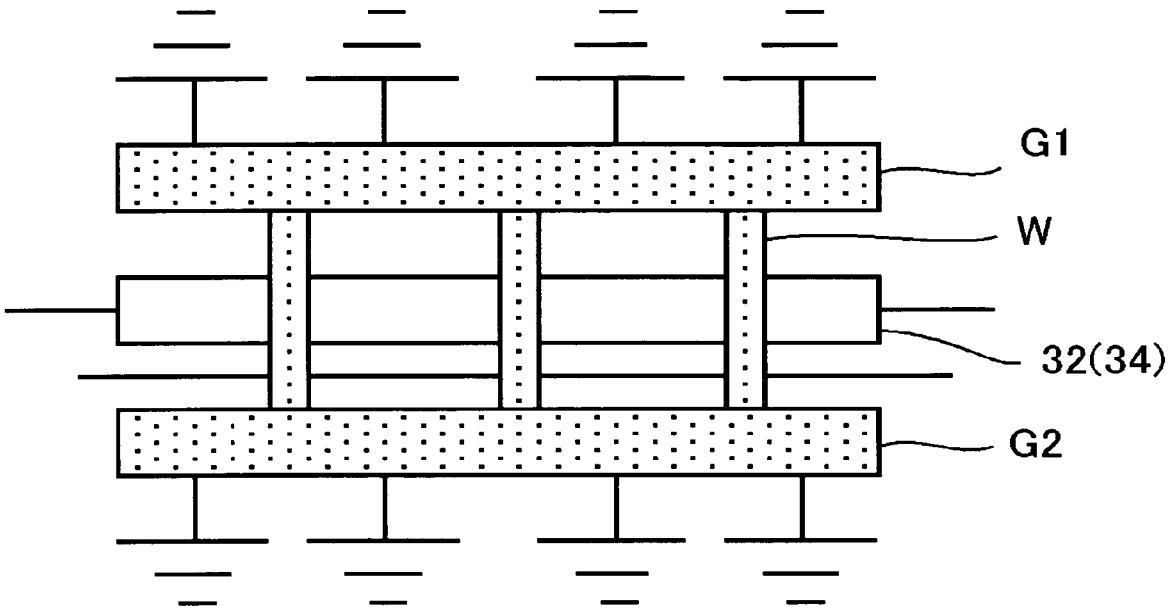
FIG. 18 is a schematic diagram showing a distributed constant FET employed with a coplanar waveguide.

When a microstrip line is employed for constituting the switch circuit 1, the transmission line 50 will herein have a characteristic impedance $Z_c$, a wavelength constant $\beta_c$ and a length $l_c$, and a dielectric substrate will have a thickness of h in common to all the transmission lines. The transmission lines 42, 44 will herein have a characteristic impedance $Z_d$, a wavelength constant $\beta_d$ and a length $l_d$, and the transmission lines 62, 64 a characteristic impedance $Z_0$, a wavelength constant $\beta_o$ and a length $l_o$. This also applies when a different type of transmission line is employed, such as a coplanar waveguide. However, when the coplanar waveguide or the like is incorporated, it is preferable to electrically connect the grounds G1, G2 disposed on the respective sides of the distributed constant FETs 32, 34 as shown in FIG. 18, depending on a length of the distributed constant FET, so as to restrain other undesired propagation modes. In FIG. 18, the grounds G1, G2 are connected to each other via a plurality of wiring W provided at a predetermined interval so as to bridge over the distributed constant FETs 32, 34.

Figure 2:
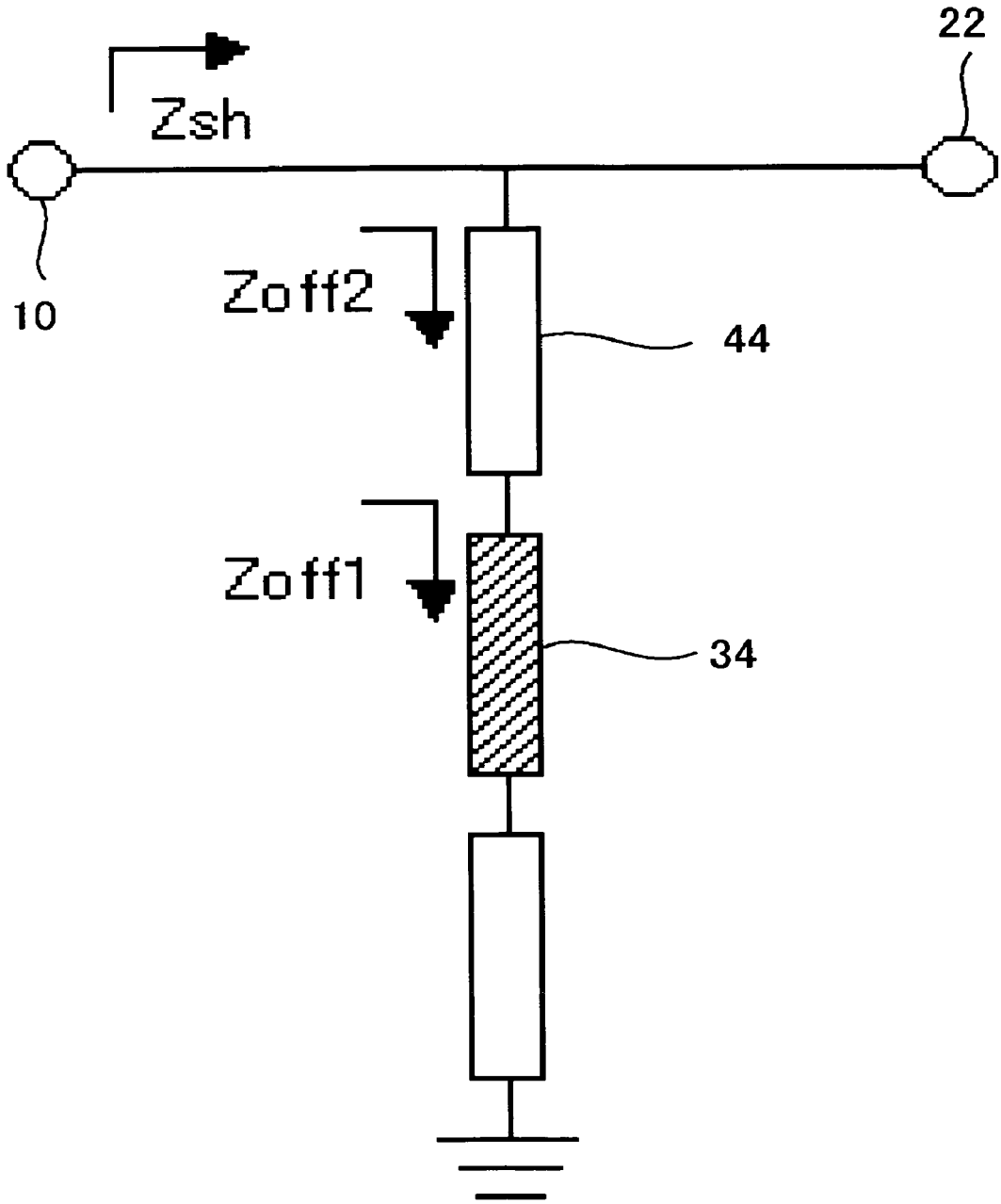
FIG. 2 is an equivalent circuit diagram of a SPDT switch simplified from the switch circuit of FIG. 1.

FIG. 2 is an equivalent circuit diagram of a SPDT switch simplified from the switch circuit 1. The microstrip line was employed to constitute the switch circuit 1, and the following constants were adopted; $Z_c$=34.6Ω, $\beta_c=5.06\times10^{-3}\mu m^{-1}$, $l_c$=160 μm, h=40 μm, $Z_d$=49Ω, $\beta_d=4.89\times10^{-3}\mu m^{-1}$, $l_d$=170 μm, $Z_0$=34.6Ω, $\beta_0=5.06\times10^{-3}\mu m^{-1}$, and $l_0$=680 μm. The distributed constant FET was set as; length L=400 μm, G=0.065 S (when the channel is open), C=10 fF/100 μm, $R_{TL}=1\times10^{-6}\Omega$, and $L_{TL}$=45 pH/100 μm. For the isolation circuits 72, 74 of the bias line, a resistance of 500Ω was employed. It is to be noted that the wavelength constant values are all under 80 GHz.

Figure 3:
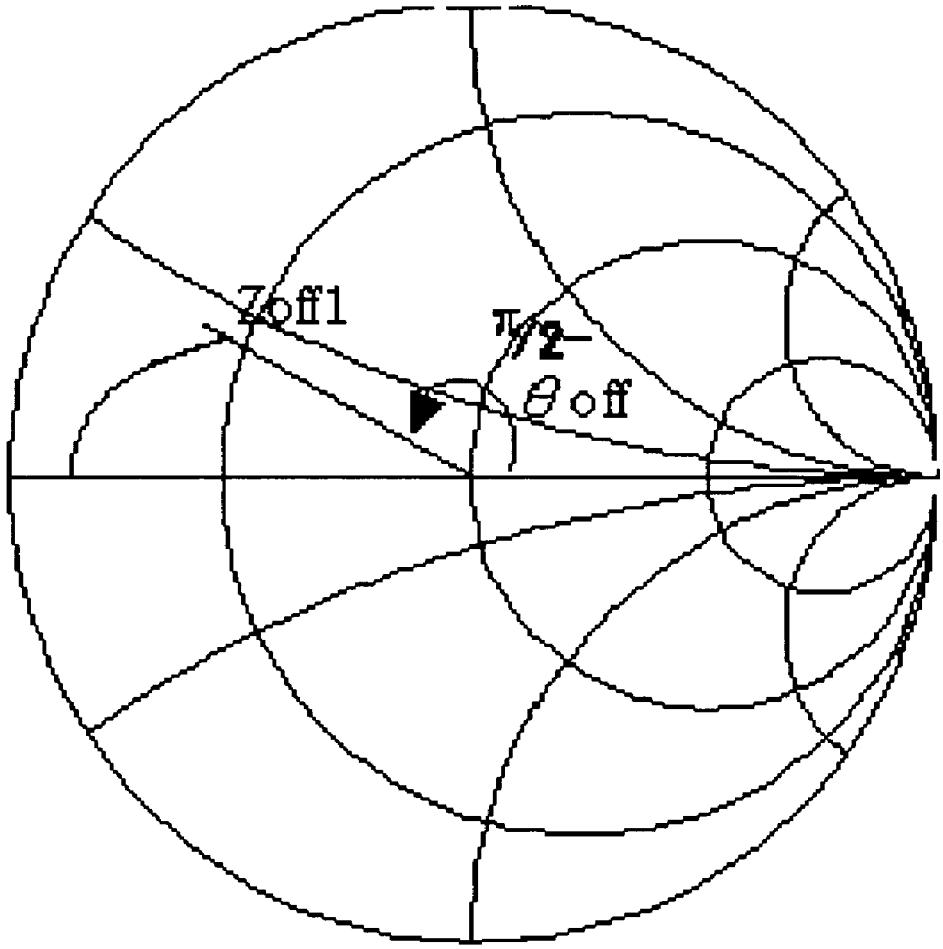
FIG. 3 is a Smith chart indicating an input impedance of a distributed constant FET (400 μm in length) in an off state, under 80 GHz.

FIG. 2 depicts an ideal status in which the path from the common terminal 10 to the branch terminal 22 is ON, and the impedance is matched to a load impedance (usually 50Ω). It is an OFF branch circuit that is inserted in parallel between the common terminal 10 and the branch terminal 22. It is ideal that the impedance $Z_{off2}$ seen from the diverging point toward the OFF branch under a desired frequency looks completely open. As shown in FIG. 3, however, the impedance $Z_{off1}$ of the distributed constant FET that is OFF acts as a transmission line with a loss, and hence the impedance increases with the frequency, while the phase rotates by the length L of the distributed constant FET. Therefore, it is understood that it is impossible, despite connecting the transmission line 44, to completely open the $Z_{off2}$ under the desired frequency.

Here, connecting the transmission line 44 having an electrical length $\theta_{off}$ to the distributed constant FET allows minimizing leakage of a RF signal to the OFF branch side and reducing the insertion loss, by maximizing the impedance $Z_{off2}$ seen from the diverging point toward the OFF branch side. Yet, since the impedance $Z_{off2}$ cannot be fully opened at the desired frequency, the impedance $Z_{sh}$ when the branch terminal 22 is seen from the common terminal 10 in FIG. 2 cannot be accurately 50Ω. The unmatched amount between the impedance $Z_{sh}$ and the impedance $Z_L$ of the common terminal 10 provokes an increase in insertion loss. Accordingly, introducing a circuit that matches $Z_{sh}$ and $Z_L$ enables minimizing the insertion loss. Such matching circuit can be achieved, as will be subsequently described, upon inserting a transmission line having a characteristic impedance $Z_c$ and a length $l_c$ (herein, the microstrip line) between the common terminal 10 and the OFF branch.

If the transmission line having a length of Λ/4 of the desired frequency were to be connected to the distributed constant FET according to the non-patent document 4, the phase would excessively rotate and hence a maximal impedance under the desired frequency would not be obtained, which provokes leakage of the RF signal to the OFF branch side thus degrading the insertion loss. Accordingly, an upper limit of $l_d$ depends on $\theta_{off}$. On the other hand, a lower limit of $l_d$ is delimited by the restriction imposed by the reflection coefficient. Consequently, it is the condition to minimize the insertion loss that the reflection coefficient $|\Gamma|$ when the branch terminal 22 is seen from the common terminal 10 in FIG. 2 is generally less than 0.25.

Figure 4:
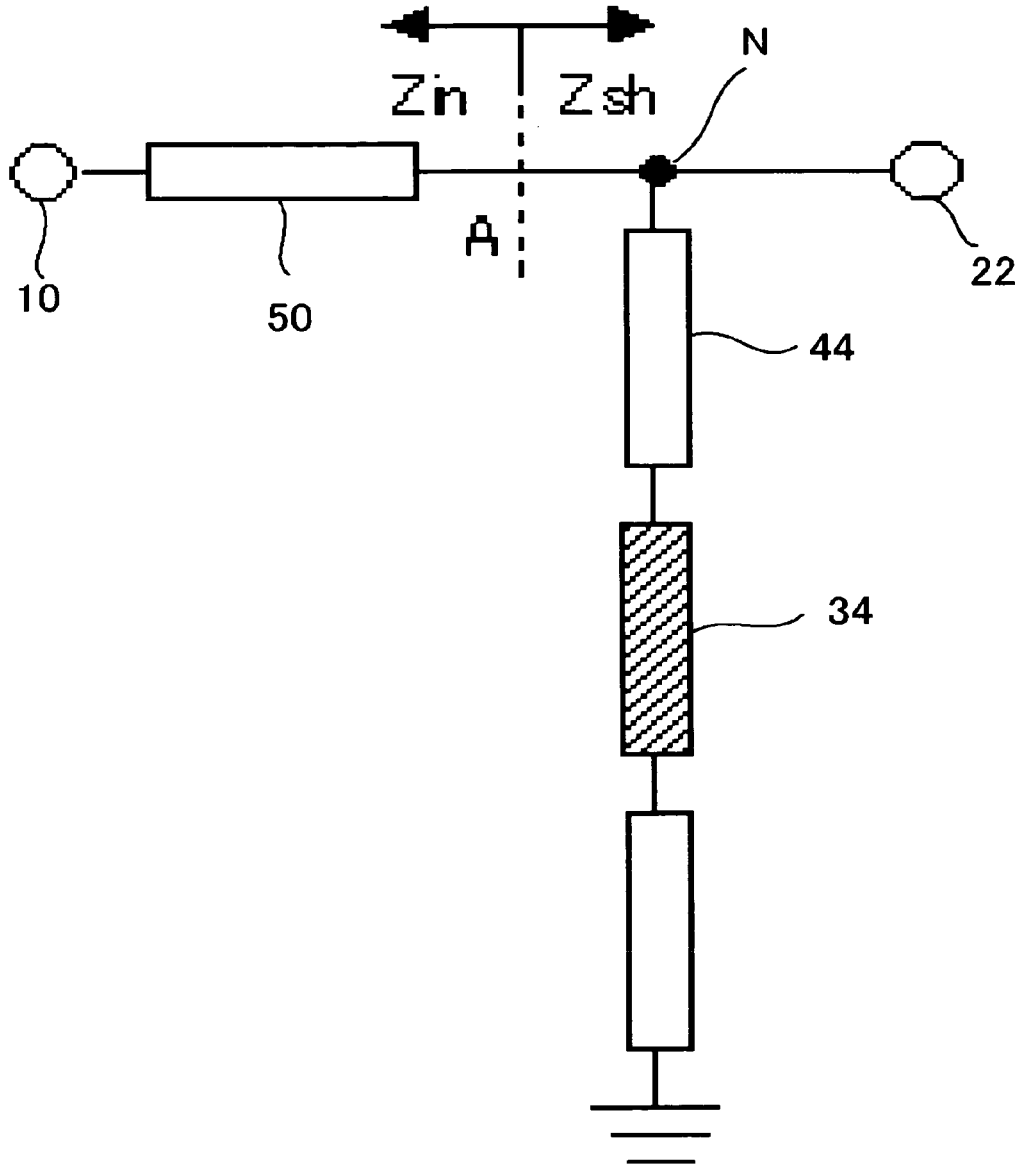
FIG. 4 is an equivalent circuit diagram of another SPDT switch simplified from the switch circuit of FIG. 1.

Also, the range of $Z_c$ and $l_c$ is determined by an impedance matching condition at a point A shown in FIG. 4. Specifically, a junction of the transmission line 50, inserted between the common terminal 10 and the diverging point N, and the diverging point is denoted as the point A, and when an impedance $Z_{in}$ when the common terminal 10 is seen from the point A and an impedance $Z_{sh}$ when the branch terminal 22 is seen from the point A through the diverging point N become a conjugate impedance, the impedances are matched at the point A, so that the insertion loss is minimized. A range of the characteristic impedance $Z_c$ of the matching transmission line that satisfies such condition is 50Ω or less, and a range of the length $l_c$ is longer than 0 and Λ/4 or shorter. When the impedance $Z_{off2}$ is at its greatest, $l_c$ becomes equal to Λ/4.

Figure 17:
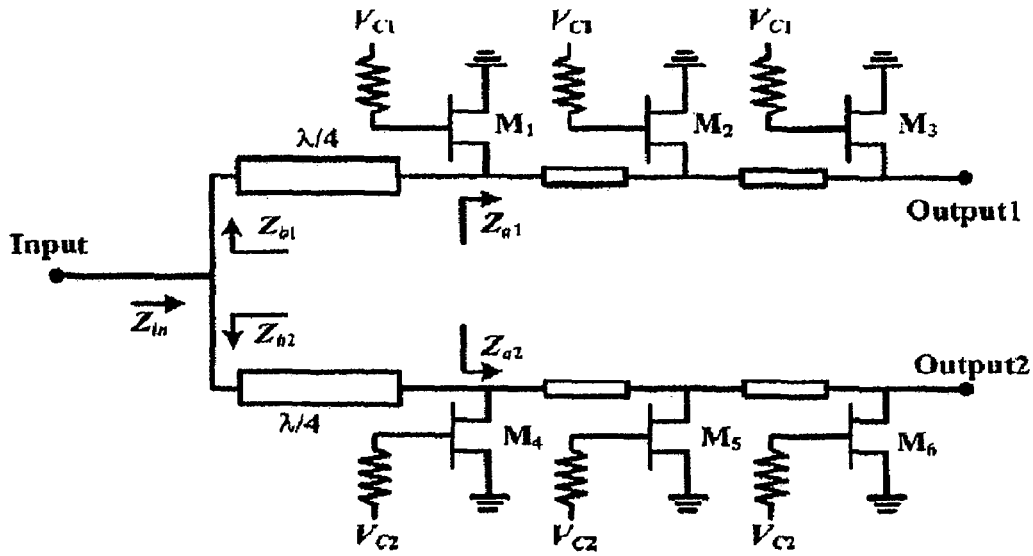
FIG. 17 RELATED ART
FIG. 17 is a circuit diagram of a traveling wave type SPDT switch according to the non-patent document 3.

Actually, the circuit shown in FIG. 17 constitutes a chip which is as large as 2.25 $mm^2$, and also incurs a large insertion loss of approx. 3 dB at 76 GHz. This is considered to be because, as already stated, the distance between the diverging point to the FET is longer than that in the present invention, which disturbs the impedance matching with respect to the OFF branch.

Thus, the traveling wave type SPnT switch including the distributed constant FET, which cannot be completely open at the diverging point as above, has to be designed so that the impedance becomes highest at the desired frequency. The length L, propagation constant $\gamma_{off}$, characteristic impedance $Z_{off}$, and impedance $Z_{off1}$ when the distributed constant FET is OFF are defined as the following formula, in which the load impedance is denoted by ZL1:

$$Z_{off1}=ZL1\{ZL1+Z_{off}\tan h(\gamma_{off}L)\}/\{Z_{off}+ZL1\tan h(\gamma_{off}L)\} \quad (1)$$

The phase $\theta_{off}$ at an upper limit in the frequency band is defined as follows:

$$\theta_{off}=\mathrm{Arctan}[Im(Z_{off1})/Re(Z_{off1})] \quad (2)$$

When designing the SPnT switch, the OFF-side branch is generally branched via the transmission line having a length of ¼ of the propagation wavelength Λ as in the conventional switches, to obtain a high impedance. However, since the distributed constant FET itself already has a certain length, the phase is rotated by $\theta_{off}$ with the frequency as is apparent from the formula (2) (Ref. FIG. 3). Accordingly, in order to obtain a maximal impedance of $Z_{off2}$, it suffices to rotate the phase by $(\pi/2-\theta_{off})$, and it is not necessary to rotate the phase by $\pi/2(=90°)$, which is a quarter of the propagation wavelength. Consequently, the length $l_d$ required for maximizing the impedance $Z_{off2}$ at the desired frequency is expressed as follows, as shown in FIG. 3:

$$l_d=\Lambda/4\cdot 2(\pi/2-\theta_{off})/\pi=\Lambda/4\cdot(1-2\cdot\theta_{off}/\pi) \quad (3)$$

In a low frequency band where the distributed constant effect is negligible, $\theta_{off}$ becomes nearly equal to 0, and hence the length $l_d$ becomes nearly equal to Λ/4, from the formula (3). However since the switch practically operates in a frequency band where the distributed constant effect of the distributed constant FET is apparent, the phase is usually rotated by a certain amount in the desired frequency band. Accordingly, it is understood that $l_d$ has to be shorter than Λ/4. Actually, when the distributed constant FET of 400 μm in length was employed, with a GaAs substrate of 40 μm in thickness, the length $l_d$ by which a maximal impedance was achieved at 80 GHz was 275 μm. Since Λ/4 of 80 GHz is 320 μm, 275 μm corresponds to 86% of Λ/4, which is shorter than Λ/4.

Thus, the conditions that delimit the length range of the branch transmission line on the OFF-side branch are provided as above. The conditions facilitate minimizing leakage of the microwave/millimeter-wave signal to the OFF branch, i.e. maximizing the isolation and minimizing the insertion loss. Regarding the SPnT switch, however, a condition that retains within a tolerance has to be studied, in addition to the condition for maximizing the isolation on the OFF-side branch. The desired SPnT switch is first achieved when these two conditions are satisfied at a time. As shown in FIG. 4, it is the condition that allows minimizing the insertion loss in an ON state of the SPnT switch to achieve the impedance matching at the point A, between the transmission line 50 inserted between the common terminal 10 serving as the common port and the point A, and the impedance of a circuit in which the OFF-side branch is connected in parallel.

Figure 5A:
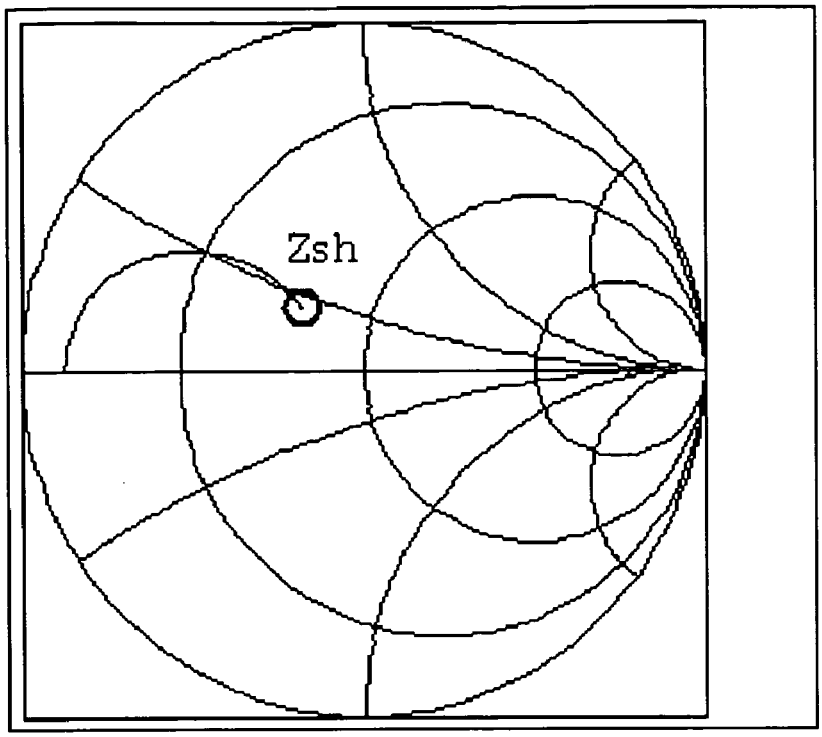
FIG. 5A is a Smith chart indicating an impedance $Z_{sh}$ when a branch terminal 22 is seen from point A through an off branch shunt circuit in FIG. 4.
Figure 5B:
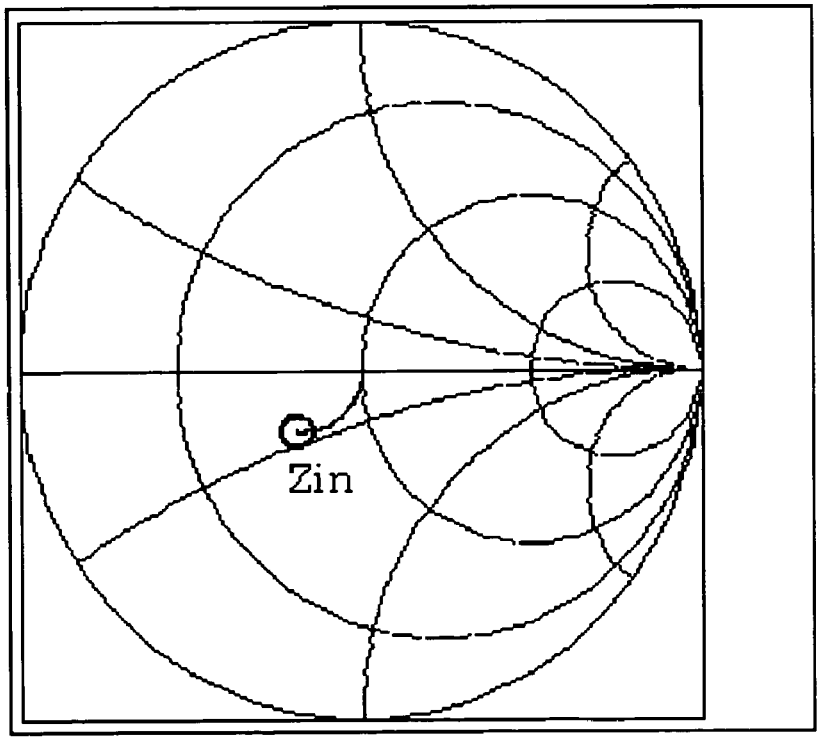
FIG. 5B is a Smith chart indicating an impedance $Z_{in}$ when a common terminal 10 is seen from the point A through a transmission line.

The impedance $Z_{in}$ of the transmission line 50, having the wavelength constant $\beta_c$, the characteristic impedance $Z_c$ and the length $l_c$, seen from the point A toward the common terminal 10 (Ref. FIG. 5B) can be expressed as follows, when an impedance of a load connected to the common port is denoted as ZL (usually 50Ω):

$$Z_{in}=Z_c\{ZL+jZ_c\tan(\beta_c l_c)\}/\{Z_c+jZL\tan(\beta_c l_c)\} \quad (4)$$

On the other hand, $Z_{off2}$ is expressed as follows, when seen through the transmission line having the wavelength constant $\beta_d$, the characteristic impedance $Z_d$, and the length $l_d$ inserted between the diverging point N and the distributed constant FET:

$$Z_{off2}=Z_d\{Z_{off1}+jZ_d\tan(\beta_d l_d)\}/\{Z_d+jZ_{off1}\tan(\beta d l_d)\} \quad (5)$$

Accordingly, the impedance $Z_{sh}$ of the circuit of OFF-side branches connected in parallel to the diverging point (Ref. FIG. 5A) can be defined as follows, when the impedance of the load connected to the common port is denoted as ZL (usually 50Ω):

$$Z_{sh}=Z_{off2}ZL/(Z_{off2}+ZL) \quad (6)$$

For achieving the impedance matching between $Z_{sh}$ and $Z_{in}$, $Z_c$, $l_c$, $Z_d$ and $l_d$ are to be selected so that $Z_{sh}$ becomes equal to $Z_{in}$*, where $Z_{in}$* represents the conjugate impedance of $Z_{in}$. In view of the impedances circled in FIGS. 5A and 5B, it is understood that the conjugate impedance matching is achieved.

What is important here is that the impedance seen through the OFF branch has to be substantially 50Ω, in order to retain the insertion loss within a practically acceptable tolerance. In other words, the absolute value $|\Gamma|$ of the reflection coefficient $\Gamma$ consisting of the input impedance $Z_{in}$ in FIG. 4 has to be 0.25 or less. This is a condition that suppresses the leakage of the RF power to the OFF branch within a tolerance, to thereby substantially match $Z_{in}$ to 50Ω.

$$|\Gamma|=|(Z_{sh}-ZL)/(Z_{sh}+ZL) \quad (7)$$

From the formula (7), $l_d$ becomes shortest when the following is satisfied:

$$|\Gamma|\leqq 0.25 \quad (8)$$

Figure 19:
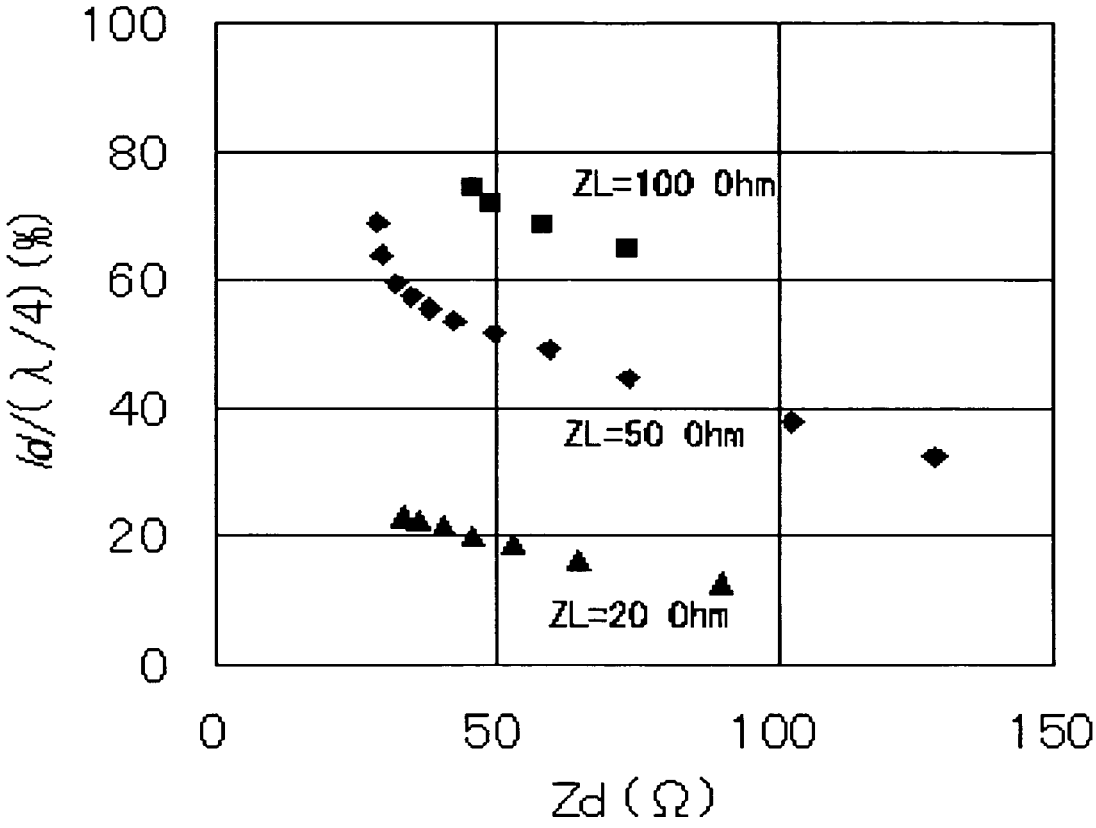
FIG. 19 is a graph showing a relation between a length of a branch transmission line and a characteristic impedance.

FIG. 19 is a graph showing a calculation result that satisfies the formula (8) with respect to the relation between the length $l_d$ standardized by Λ/4 and the branch transmission line $Z_d$. The result reflects the cases where ZL is set as 20 Ω, 50Ω and 100Ω respectively. Generally the port impedance ZL is 50Ω, and the characteristic impedance $Z_d$ of an interconnect is usually utilized under 75Ω or less where a conductor loss and dielectric loss are within a tolerance, to achieve low loss characteristic in the switch circuit. Accordingly, from FIG. 19 it is understood that the desired length $l_d$ is 45% or more of Λ/4.

Figure 6:
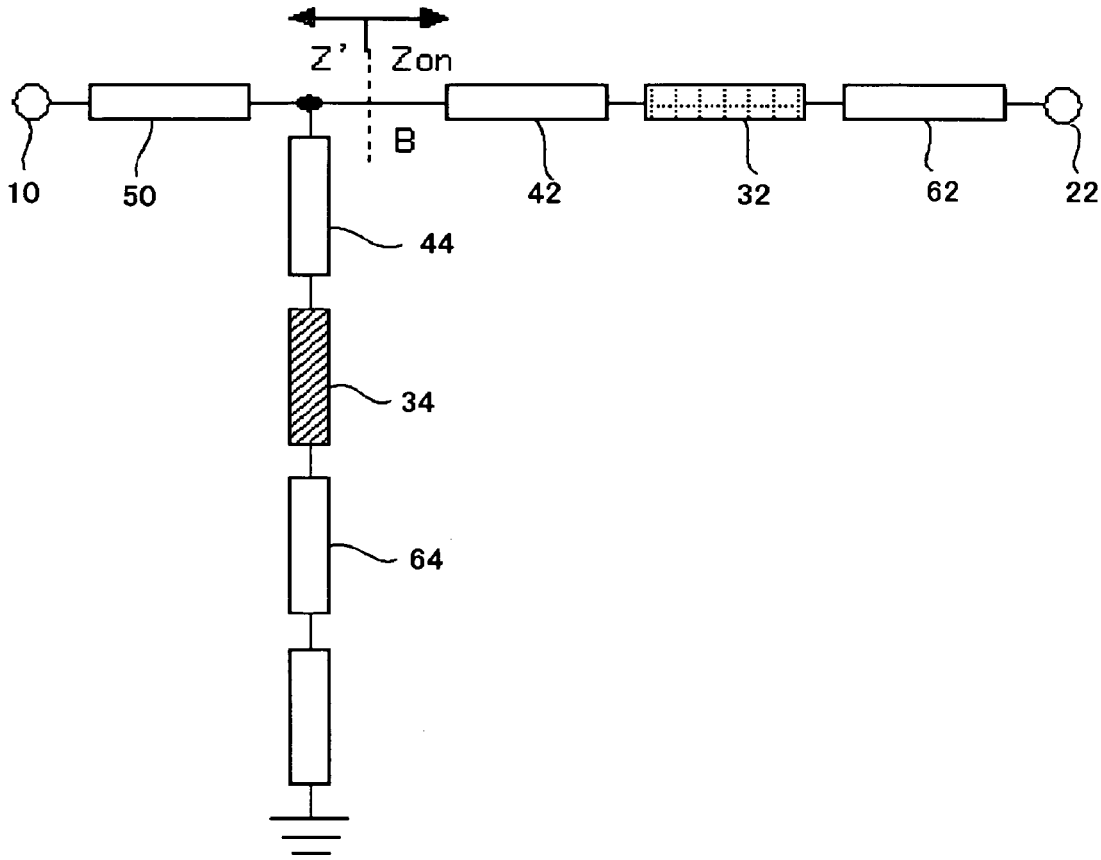
FIG. 6 is an equivalent circuit diagram showing the switch circuit 1.

In the ON branch, which is inserted between point B and the branch terminal 22 in FIG. 6, an identical element to that of the OFF branch is inserted. The only difference is in the bias condition. In this embodiment for example, the bias voltage to the OFF branch is 0 V, that to the ON branch is −5 V.

Figure 7A:
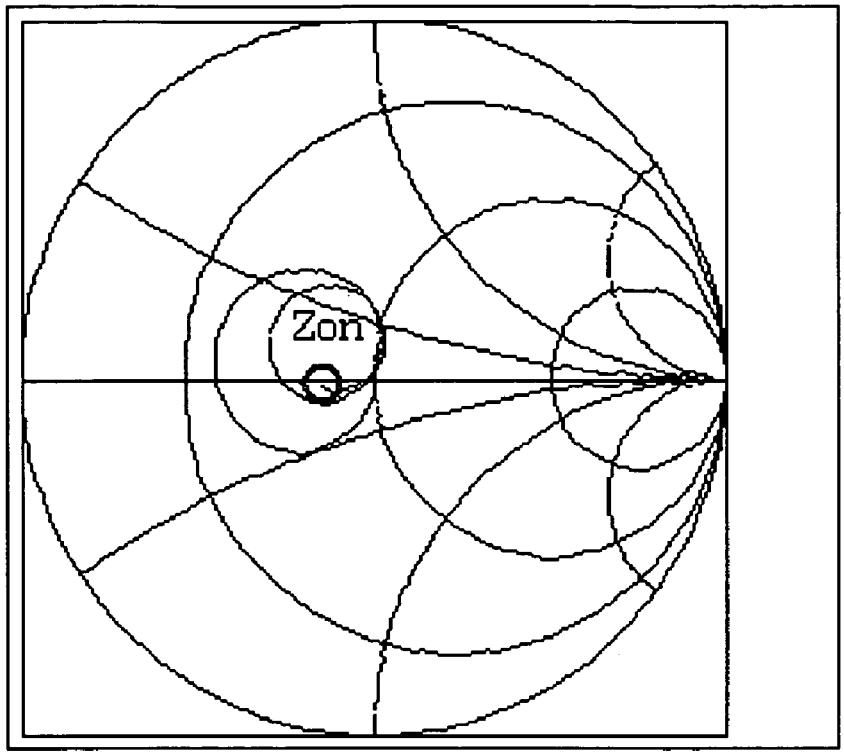
FIG. 7A is a Smith chart indicating an impedance $Z_{on}$ when a branch terminal 22 is seen from point B through an on branch in FIG. 6.
Figure 7B:
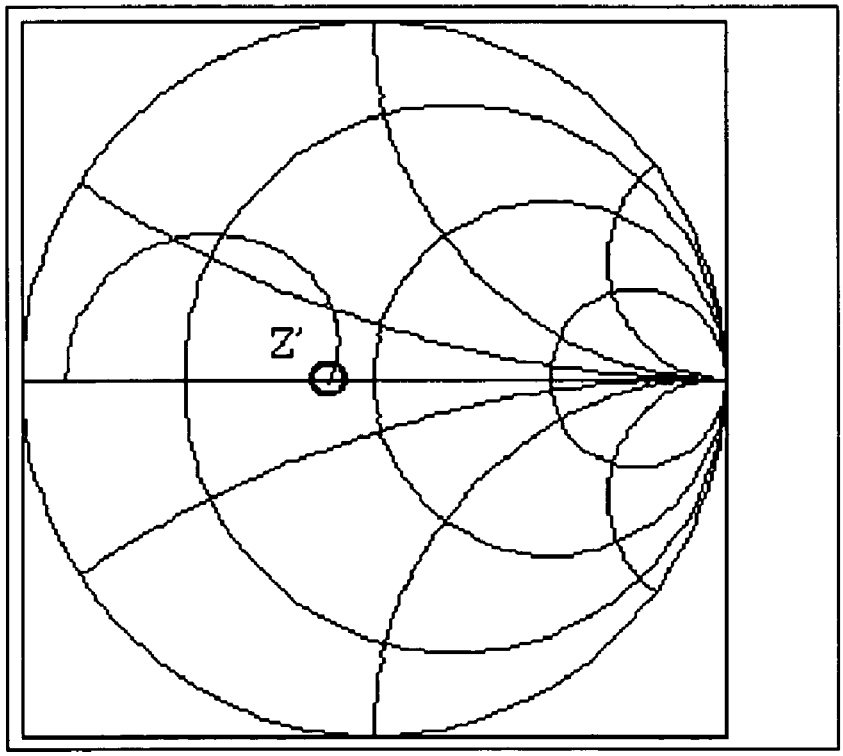
FIG. 7B is a Smith chart indicating an impedance Z' when a common terminal 10 is seen from point B through an off branch shunt circuit and an input transmission line.

FIG. 7 shows the impedance at the point B in this embodiment. From FIG. 7, it is apparent that the impedance $Z_{on}$ when the branch terminal 22 is seen from the point B and the impedance Z' when the common terminal 10 is seen from the point B are in a conjugate impedance matching. Here, the transmission lines 62, 64 are matching circuits with respect to the input impedance of the branch terminals 22, 24 respectively. Specifically, when P1 denotes the path in an ON state for example, the impedance when the common terminal 10 is seen from the junction with the distributed constant FET 32 of the transmission line 62 is converted to the impedance of the branch terminal 22 (usually 50Ω), in the desired frequency band. Thus, this embodiment provides the SPDT switch which incurs an insertion loss of 1.7 dB at 76 GHz, which is considerably lower than approx. 3 dB in the conventional switch circuit. Also, the traveling wave type SPDT switch according to this embodiment achieves excellent characteristics such as an insertion loss of 2.1 dB or lower and an isolation of 25 dB or higher, over a frequency band as wide as 38 GHz to 80 GHz, which exceeds one octave.

As described throughout the foregoing passages, in the switch circuit 1, making the transmission lines 42, 44 longer than 45% of Λ/4 allows suppressing the insertion loss under an ON state within a tolerance. Also, making the transmission lines 42, 44 shorter than Λ/4 allows maximizing the isolation of the branch path in an OFF state. Such structure facilitates the switch circuit 1 to maximize the isolation of the OFF-side branch, as well as to retain the insertion loss in an ON state within a tolerance.

Thus, the foregoing embodiment explicitly delimits the range of the branch circuit of the traveling wave type SPnT switch (optimal length of the transmission line between the diverging point to the FET), thereby contributing to industrial development of the traveling wave type SPnT switch.

Meanwhile, the conventional art disclosed in the patent document 4 cited above is useful in attaining a SPnT switch circuit that includes a coplanar waveguide, but does not refer to application to a different transmission line such as the microstrip line. In contrast, the foregoing embodiment may be suitably applied to a different transmission line such as the microstrip line.

The switch circuit 1 includes the transmission line 50. Such structure allows properly matching the impedance of the common terminal 10 and the impedance when the branch path in an ON state is seen from the common terminal 10.

The switch circuit 1 also includes the distributed constant FET. This makes the switch circuit 1 quite appropriate for achieving broadband characteristics.

When employing the coplanar waveguide as the transmission lines 42, 44, electrically connecting the grounds G1, G2 disposed on the respective sides of the distributed constant FETs 32, 34 as shown in FIG. 18 can enhance the potential of the ground plane. Also, employing a wiring for the connection allows enhancing the ground plane with a simple structure.

The switch circuit according to the present invention is not limited to the foregoing embodiment, but may be modified in various manners. To cite a few examples, while the embodiment refers to the SPDT switch, the switch circuit according to the present invention may be applied to a SPnT switch in which n is three or more.

Figure 8:
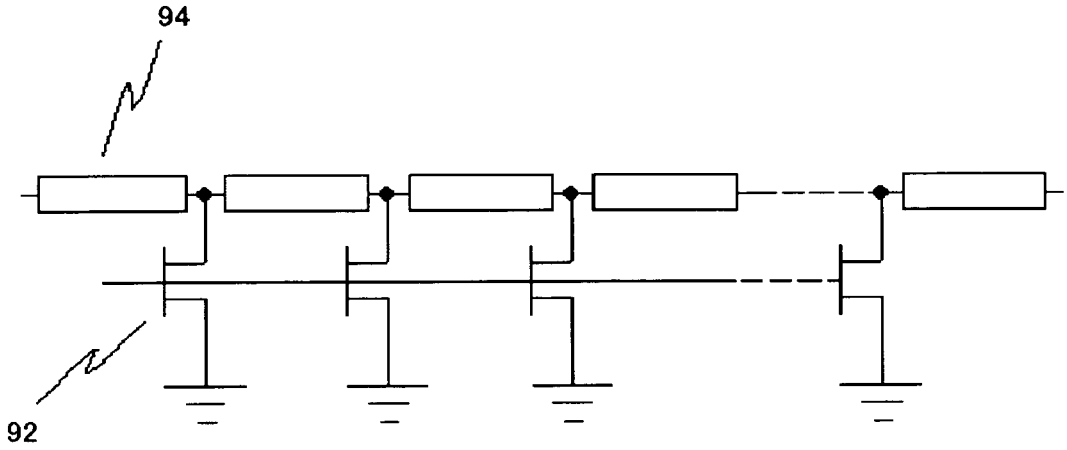
FIG. 8 is a circuit diagram for explaining a switch circuit according to another embodiment.
Figure 9A:
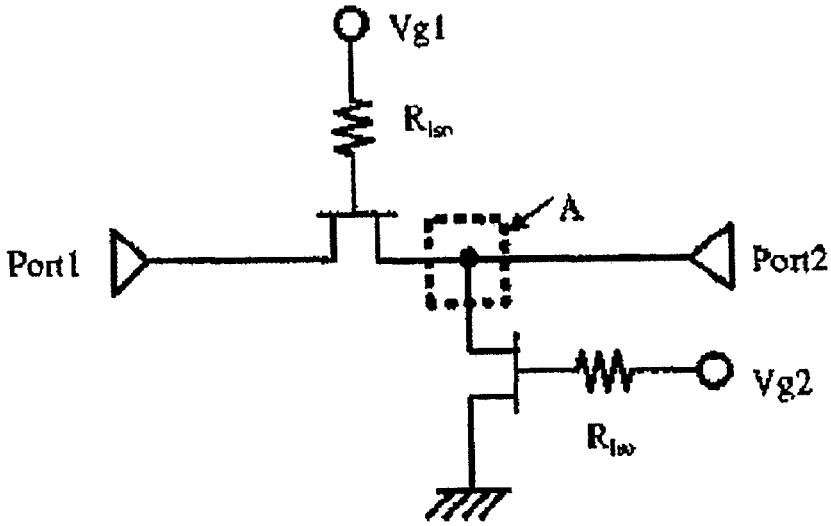
FIG. 9A RELATED ART
FIG. 9A is a circuit diagram of a conventional series-shunt SPST switch circuit.
Figure 9B:
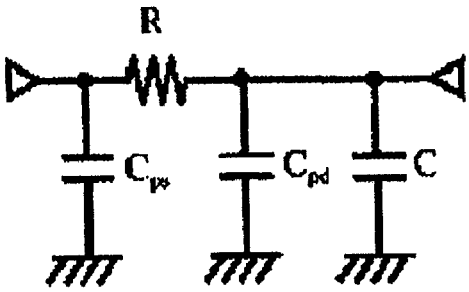
FIG. 9B RELATED ART
FIGS. 9B and 9C are equivalent circuit diagrams of the conventional SPST switch circuit, the former in an ON state and the latter in an OFF state.
Figure 9C:
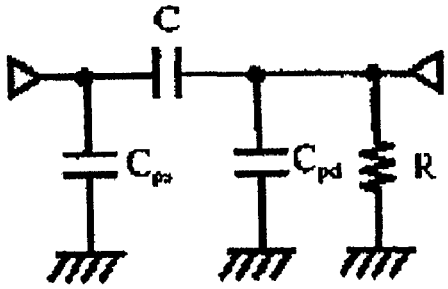
FIG. 9C RELATED ART
Figure 10:
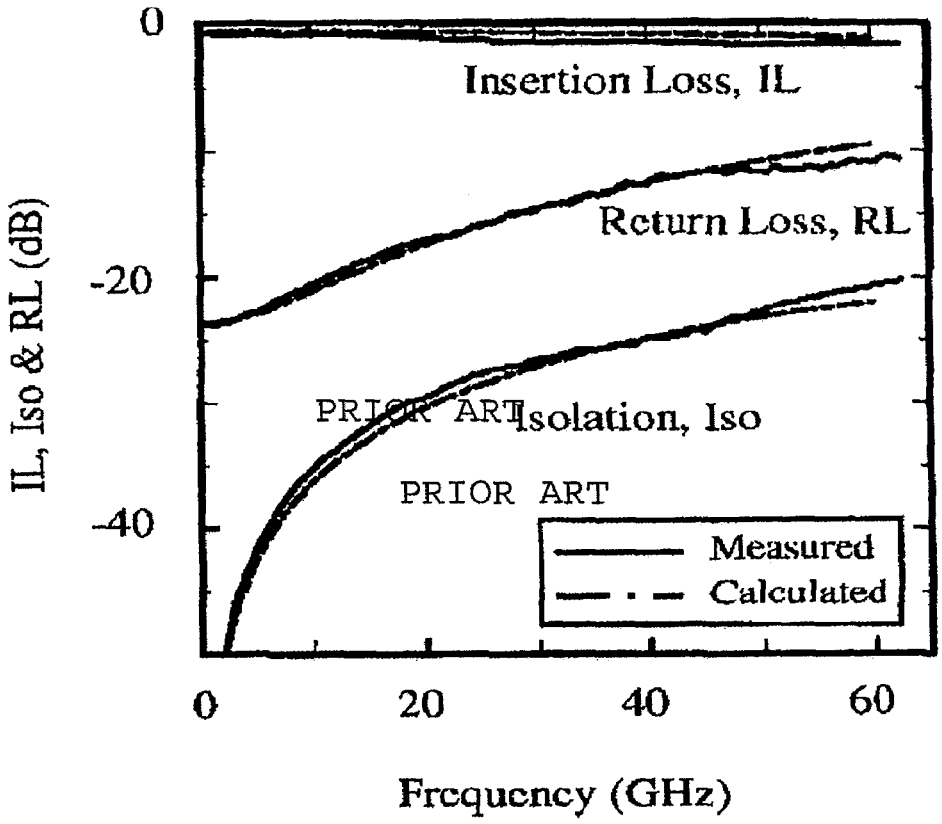
FIG. 10 RELATED ART
FIG. 10 is a graph showing frequency characteristics with respect to insertion loss and isolation of the conventional series-shunt SPST switch.

Also, the traveling wave type SPST switch shown in FIG. 8, including n pieces of FETs 92 that can be considered as lumped constant FETs and the transmission line 94, is within the scope of the present invention, because this switch can be handled in the same way as the switch with the distributed constant FET according to the present invention. For instance, the switch circuit 1 including a traveling wave type SPST switch with four FETs of 100 μm in $W_g$ and a transmission line of 50 μm in length disposed among the FETs, instead of the distributed constant FET, may be employed to constitute the traveling wave type SPDT switch. Further, a diode such as a shot key diode or a PIN diode may be employed in place of the field-effect transistor, to achieve similar advantageous effects. In such case, for example the anode of a diode may be utilized as the gate of the field-effect transistor, and the cathode as the source and the drain.

It is apparent that the present invention is not limited to the above embodiment, and may be modified and changed without departing from the scope and spirit of the invention.

What is claimed is:

1. A switch circuit comprising:

a common terminal;

a plurality of branch terminals;

a common path connecting said common terminal and a diverging point;

a plurality of branch paths respectively connecting said diverging point and said branch terminals;

a field effect transistor provided in each of said branch paths; and a transmission line provided in each of said branch paths, between said diverging point and said field effect transistor;

wherein said transmission line is longer than 45% of Λ/4 but shorter than Λ/4, when Λ represents a propagation wavelength under an operating frequency.

2. The switch circuit according to claim 1, further comprising a matching circuit provided in said common path, and matching an impedance of said common terminal and an impedance when a first branch path of said plurality of branch paths that is in an ON state is seen from said common terminal through a second branch path of said plurality of branch paths that is in an OFF state connected in parallel to said diverging point.

3. The switch circuit according to claim 1,
wherein said field effect transistor is a distributed constant field effect transistor.

4. The switch circuit according to claim 3,
wherein said transmission line is a coplanar waveguide;
and grounds provided on the respective sides of said distributed constant field effect transistor are mutually electrically connected.

5. The switch circuit according to claim 4,
wherein said grounds are mutually connected via a plurality of interconnects disposed at a predetermined interval so as to bridge over said distributed constant field effect transistor.

* * * * *